US008833881B2

(12) United States Patent
Manniso et al.

(10) Patent No.: US 8,833,881 B2
(45) Date of Patent: Sep. 16, 2014

(54) PARTS STORAGE DRAWER SYSTEM

(75) Inventors: Mark L Manniso, Newark, DE (US); James L Manniso, Newark, DE (US)

(73) Assignee: Forte USA, Newark, DE (US)

( * ) Notice: Subject to any disclaimer, the term of this patent is extended or adjusted under 35 U.S.C. 154(b) by 34 days.

(21) Appl. No.: 13/523,671

(22) Filed: Jun. 14, 2012

(65) Prior Publication Data

US 2012/0319550 A1 Dec. 20, 2012

Related U.S. Application Data

(60) Provisional application No. 61/520,773, filed on Jun. 15, 2011.

(51) Int. Cl.

| | |
|---|---|
| ***A47B 88/00*** | (2006.01) |
| ***A47B 81/00*** | (2006.01) |
| ***B42F 21/00*** | (2006.01) |
| ***B42F 7/00*** | (2006.01) |
| ***B42F 17/00*** | (2006.01) |
| ***A47G 29/00*** | (2006.01) |
| ***A47F 7/16*** | (2006.01) |
| ***A47F 5/00*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***A47B 88/20*** | (2006.01) |

(52) U.S. Cl.

CPC ..... *A47B 88/20* (2013.01)
USPC ..... 312/348.3; 211/184; 211/10; 211/46; 312/234.5; 312/193; 312/265.5; 220/545

(58) Field of Classification Search

USPC ..... 312/348.3, 265.5, 265.6, 234.4, 264.5, 312/35, 193, 183, 234.5; 108/60, 61; 211/184, 10, 46; 220/544, 545, 543, 220/534, 529

See application file for complete search history.

(56) References Cited

U.S. PATENT DOCUMENTS

| | | | |
|---|---|---|---|
| 381,143 A | 4/1888 | Kimball | |
| 1,389,986 A | 9/1921 | Ristenpart | |

(Continued)

FOREIGN PATENT DOCUMENTS

| | | | | |
|---|---|---|---|---|
| DE | 3700435 A1 * | 7/1988 | ..... | A47B 88/20 |
| EP | 438943 A1 * | 7/1991 | ..... | A47B 88/20 |

(Continued)

*Primary Examiner* — Janet M Wilkens
*Assistant Examiner* — Andrew Roersma
(74) *Attorney, Agent, or Firm* — Invention To Patent Services; Alex R Hobson

(57) ABSTRACT

A parts storage drawer system is described having part bin dividers that are easily adjusted by sliding the divider along a rail or divider enables changing of divider location without removal of the divider from the drawer. A parts identification card may be coupled to a divider, such as by insertion into a slot within a divider. Furthermore, a parts identification card may be inserted into and removed from a divider without removing or repositioning the divider. A parts storage drawer system may be an insert tray that may comprise one or more molded parts. The parts storage drawer system provides an organizational method for the storage, separation, identification and availability of a variety of parts through the utilization of mechanical means, including dividers having clips that extend over partitions or rails for coupling thereto. Partitions and/or rails may include a plurality of locking segments for detachably attaching dividers.

14 Claims, 14 Drawing Sheets

(56) References Cited

U.S. PATENT DOCUMENTS

| | | | | | |
|---|---|---|---|---|---|
| 1,677,544 | A | * | 7/1928 | Gourley et al. | 312/117 |
| 1,688,003 | A | * | 10/1928 | Darby | 312/140.3 |
| 1,704,365 | A | * | 3/1929 | McCauley | 211/128.1 |
| 1,876,043 | A | | 9/1932 | Bowman | |
| 1,995,335 | A | * | 3/1935 | Wilke | 312/140 |
| 2,148,681 | A | | 2/1939 | Cameron | |
| 2,218,300 | A | | 9/1940 | Schuster | |
| 2,504,466 | A | * | 4/1950 | Stolzoff | 211/11 |
| 2,594,653 | A | | 4/1952 | Jertson | |
| 2,985,333 | A | | 2/1960 | Kirkman | |
| 3,358,692 | A | | 12/1967 | Proulx | |
| 3,499,540 | A | | 3/1970 | Huncovsky | |
| 3,698,568 | A | * | 10/1972 | Armstrong | 211/184 |
| 3,708,709 | A | | 1/1973 | Morrison et al. | |
| 3,834,778 | A | | 9/1974 | Morrison et al. | |
| 3,905,484 | A | | 9/1975 | Dean | |
| 4,102,470 | A | | 7/1978 | Timmons | |
| 4,436,215 | A | | 3/1984 | Kleinert et al. | |
| 4,436,355 | A | | 3/1984 | Fortune | |
| 4,499,128 | A | | 2/1985 | Strausheim | |
| 4,499,997 | A | * | 2/1985 | Swingley, Jr. | 206/509 |
| 4,577,773 | A | | 3/1986 | Bitel | |
| 4,638,908 | A | | 1/1987 | Baitz et al. | |
| 4,786,785 | A | | 11/1988 | Felt et al. | |
| 4,909,384 | A | | 3/1990 | About | |
| 4,993,786 | A | | 2/1991 | Giulio | |
| 5,037,165 | A | | 8/1991 | Rapp et al. | |
| 5,058,765 | A | | 10/1991 | Gomi et al. | |
| 5,167,433 | A | * | 12/1992 | Ryan | 296/37.1 |
| 5,257,693 | A | | 11/1993 | Kwasniak | |
| 5,295,742 | A | | 3/1994 | Knutson | |
| 5,311,993 | A | | 5/1994 | Koch | |
| 5,385,230 | A | | 1/1995 | Windorski et al. | |
| 5,443,160 | A | | 8/1995 | Tortorella et al. | |
| 5,468,062 | A | | 11/1995 | Finnegan | |
| 5,469,975 | A | * | 11/1995 | Fajnsztajn | 211/10 |
| 5,738,425 | A | | 4/1998 | Gledhill et al. | |
| 5,803,276 | A | | 9/1998 | Vogler | |
| 5,806,941 | A | * | 9/1998 | Diederich et al. | 312/183 |
| 5,853,239 | A | | 12/1998 | Laib et al. | |
| 5,971,173 | A | * | 10/1999 | Valiulis et al. | 211/184 |
| 5,992,959 | A | | 11/1999 | Kawamoto | |
| 6,082,537 | A | | 7/2000 | Quinn | |
| 6,244,447 | B1 | * | 6/2001 | Frieze et al. | 211/85.13 |
| 6,871,921 | B2 | * | 3/2005 | Ernst | 312/348.3 |
| 6,889,854 | B2 | | 5/2005 | Burke | |
| 7,163,118 | B2 | * | 1/2007 | Cheng | 220/528 |
| 7,172,258 | B2 | * | 2/2007 | Bisson et al. | 312/348.3 |
| 7,681,746 | B2 | * | 3/2010 | Schmidt | 211/184 |
| 2003/0034319 | A1 | * | 2/2003 | Meherin et al. | 211/184 |
| 2003/0137227 | A1 | | 7/2003 | Hoenig | |
| 2004/0004420 | A1 | | 1/2004 | Pine et al. | |
| 2004/0149758 | A1 | | 8/2004 | Duquette | |
| 2004/0155564 | A1 | | 8/2004 | Berger et al. | |
| 2004/0245254 | A1 | | 12/2004 | Pine et al. | |
| 2005/0263580 | A1 | | 12/2005 | Brown et al. | |
| 2006/0124647 | A1 | | 6/2006 | Rosenberg et al. | |
| 2007/0035221 | A1 | | 2/2007 | Koo et al. | |
| 2007/0273258 | A1 | | 11/2007 | Ernst | |
| 2008/0073241 | A1 | | 3/2008 | Austern et al. | |
| 2008/0128428 | A1 | | 6/2008 | Beckerman | |
| 2008/0258593 | A1 | | 10/2008 | Berger | |
| 2011/0084584 | A1 | | 4/2011 | Curtin | |
| 2011/0115630 | A1 | | 5/2011 | Hughes | |
| 2012/0037520 | A1 | | 2/2012 | Bartlett et al. | |

FOREIGN PATENT DOCUMENTS

| | | | | | |
|---|---|---|---|---|---|
| EP | 510942 | A1 | * | 10/1992 | A47B 88/20 |
| FR | 2566251 | A1 | * | 6/1984 | A47B 88/20 |

* cited by examiner

PARTS STORAGE DRAWER SYSTEM

CROSS REFERENCE TO RELATED APPLICATIONS

This application claims the benefit of U.S. provisional patent application Ser. No. 61/520,773 filed on Jun. 15, 2011 which is incorporated herein by reference in its entirety.

BACKGROUND OF THE INVENTION

1. Field of the Invention

The invention relates to parts storage drawers with adjustable bin sizes.

2. Background

There is a wide range of applications for the storage of parts within a drawer. Many drawers have preset bin sizes or are configured with partitions that may be moved to create a different bin size. Unfortunately, modification of a bin size typically requires the removal of one or more partitions, which can lead to parts becoming scattered or mixed. Some drawer insert trays are available, however these trays either have fixed part bin sizes or similar types of partitions and spacers that have to be removed when a change in bin size is desired. There exists a need for a storage drawer system with bins that can be adjusted in size while retaining parts within the bins.

SUMMARY OF THE INVENTION

The invention is directed to a parts storage system having part bins that can be adjusted in size without the removal of a divider or partition. In an exemplary embodiment of a parts storage system as described herein, a storage drawer has at least one partition, one or more dividers and a parts identification card inserted into the divider or dividers. A parts storage cabinet may comprise a number of parts storage drawers, as described herein. In one embodiment, a storage drawer insert tray is provided having partitions and dividers. A storage drawer insert tray may be configured to attach to an existing drawer, or simply be configured for placement within an existing drawer. A storage drawer insert tray may be an integral insert tray wherein the base, side, front and back rails are all formed by a single molded material. In an exemplary embodiment, an integral insert tray comprises at least one integral partition, wherein a partition extending between two opposing rails is formed from the same material as the integral insert tray. An integral insert tray may be placed into a drawer and dividers may attached to form part bins.

A parts storage drawer or insert tray, as described herein, may have any suitable dimensions including a length or width greater than about 5 cm, greater than about 10 cm, greater than about 20 cm, greater than about 30 cm, greater than about 50 cm, greater than about 80 cm, and any range between and including the dimension provided. A parts storage drawer or insert tray may have any suitable height including, but not limited to, greater than about 1 cm, greater than about 3 cm, greater than about 5 cm, greater than about 10 cm, greater than about 15 cm, and any range between and including the height dimensions provided.

In an exemplary embodiment, a storage drawer of the present invention comprises at least one partition and at least one divider. In one embodiment, a drawer or drawer insert tray, as described herein, comprises a base member, two opposing side rails, a front and back rail, and at least one partition rail oriented between two opposing rails. The parts storage system may further comprise at least one part identification card that is configured to be detachably attached to a divider and may be configured for attachment and detaching from the divider without removing the divider from the drawer or insert tray. A divider may be attached into a drawer or insert tray by detachably attaching the divider between a partition(s) and/or rail(s). A divider may comprise a retainer portion that is configured for coupling to a locking segment on a rail or partition. For example, a partition or rail may comprise a groove that is configured for accepting a portion of a divider, whereby a divider can be pressed into the groove and securely retained in that position. A plurality of grooves or other locking segments may be configured along a divider or rail, thereby providing incremental adjustment of the location of a divider. The groove type lock segments provide for secure retention of a divider. A divider may further comprise a clip type retainer portion that is configured to couple to a partition or rail. A clip portion may comprise an enlarged portion that is configured to nest or couple with a recessed portion of a partition or rail, or over an enlarged portion of a partition or rail.

A part identification card may be coupled to a divider in any suitable way including with a part identification card retainer. A part identification card retainer may comprise a slot or opening in a divider, or may comprise clips, flanges or any other suitable feature for coupling a part identification card to a divider. In one embodiment, a part identification card may be detachably attached to a divider by being inserted into an opening within a divider, and may be transferred from one divider to another. A part identification card may comprise any suitable type of label or identification type including, but not limited to, a bar code, quick response (QR) code, or a written or printed identification. A part identification card may further comprise a label attachment feature including, but not limited to, a slot, clip(s), or any other suitable feature for detachably attaching an identification label to the part identification card.

A lock segment for retaining a divider may be configured in any suitable way, and may be an integral part of a partition and/or rail. In one embodiment, a lock segment comprises a plurality of grooves extending along a portion of the height of a partition or rail. In another embodiment, the grooves extend along a portion of the height of a partition or rail, but do not extend to the base. In another embodiment, a partition or rail is configured with a slot type locking segment that extends along a portion of the height of the partition or rail. A divider, or a part identification card may be configured to be inserted into a slot. In yet another embodiment, a partition or rail may comprise protrusion type locking segments. Locking segments may be configured to have any suitable spacing there between including, but not limited to, greater than about 1 cm, greater than about 2 cm, greater than about 4 cm, greater than about 5 cm, and any range between and including the spacing dimensions provided. Locking segments may be configured with uniform spacing along any portion of the length of a rail or partition. In yet another embodiment, the locking segments have non-uniform spacing, and may only be configured along a portion of the length of a partition or rail. Any suitable combination of locking segment types may be configured into a part storage drawer system. For example, a partition may comprise a groove type locking segment and a rail may comprise protrusion type locking segment.

A partition may be configured along one or more of the rails to provide locking segments for dividers along a rail or rails. For example, a pair of partitions may be inserted into a drawer against and parallel with the two side rails. Dividers may then be inserted between the two partitions into the partition locking segments. A partition may be configured with locking segments on one or both sides of the partition. For example, a partition may be configured to extend between a front and back rail, and may comprise locking segments on both sides whereby bins on either side of the partition may be configured by insertion of dividers on each side.

A divider may comprise a retainer portion that is configured for insertion into a groove type locking segment. A divider retainer portion may be configured on one end, and preferably on both ends of a divider. In an exemplary embodiment, a retainer portion of a divider is a wider portion than the rest of the divider body portion, and may have any suitable height.

In another embodiment, a divider end or ends is configured with a divider end slot, whereby a part identification card may be inserted and protrude therethrough. A partition or rail may be configured with a slot or groove whereby insertion of a part identification card through a divider end slot is captured in a retaining slot or groove. This configuration may be used to ensure that a divider is correctly positioned between the partitions and/or rails, as the part identification card cannot be inserted unless the divider end slot and retaining slot align properly, for example. Without the card inserted into the divider end slot, the drawer may not be closed, as the card may extend up too high.

A divider may further comprise a clip portion for coupling a divider to a partition or rail. A divider clip portion may extend from the top portion of one or preferably both ends of a divider and may be configured to extend over a rail or partition and nest with a matching geometry on a partition or rail. For example, a divider clip may comprise an enlarged clip portion that is configured to nest with a clip receiver. In an exemplary embodiment, a clip receiver is a recessed portion of a partition or rail. In another exemplary embodiment, a clip receiver is an enlarged portion whereby a clip portion is configured for extending there over. For example, a divider clip portion may be configured to flex when a divider is pressed down onto a partition or rail, thereby allowing an enlarged clip portion to move over an enlarged or bead shaped clip receiver of a partition or rail.

A partition or rail may further comprise a partition retainer for retaining a partition. A partition may extend between the front and back rail, or between the left and right rail, as described herein. In yet another embodiment however, a partition may extend between a rail and another partition, or between two partitions. A partition may be configured with ends having a partition retainer portion similar to a divider retainer portion.

The parts storage system including, but not limited to, the storage drawer, partitions, dividers, part identification cards, insert tray and the like may be made out of any suitable material including plastic, and preferably sterilizable plastic in cases where medical parts are to be stored. Any suitable type of sterilization may be performed on a parts storage system, or inset tray as described herein including, but not limited to, steam, ethylene oxide, ozone, radiation, and the like. In an exemplary embodiment, a parts storage drawer, or components of the parts storage drawer such as the dividers, are made out of translucent or transparent material. Transparent dividers would allow a user to more easily see parts within the bins.

A parts storage drawer system, as described herein may be used in any suitable application including, but not limited to electronic, mechanical, medical, automotive, pharmaceutical, and the like. A parts storage drawer system may be used in a manufacturing environment, where parts for assembly and or parts for equipment of manufacture, including critical spares are stored. In an exemplary environment, a parts storage drawer is used for medical applications and may store parts for procedures including, but not limited to, small fragment wrist or ankle procedures. A parts storage drawer or insert bin may be loaded with parts for a particular medical procedure and comprise screws, rods, clamps, etc. In addition, an insert bin may comprise a cover such as a lid, and a lid may be transparent or comprise holes to allow for sterilization of parts within the bin. For example, an insert bin may be loaded with parts for an ankle procedure, and a lid having at least one opening to allow the ethylene oxide to penetrate into the bin may be placed onto the bin. The bin may then be subjected to ethylene oxide sterilization and then sealed in a bag or container to prevent contamination. The bin may then be delivered to a hospital or clinic where it may be used for a procedure without the need for any further cleaning or sterilization.

The summary of the invention is provided as a general introduction to some of the embodiments of the invention and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
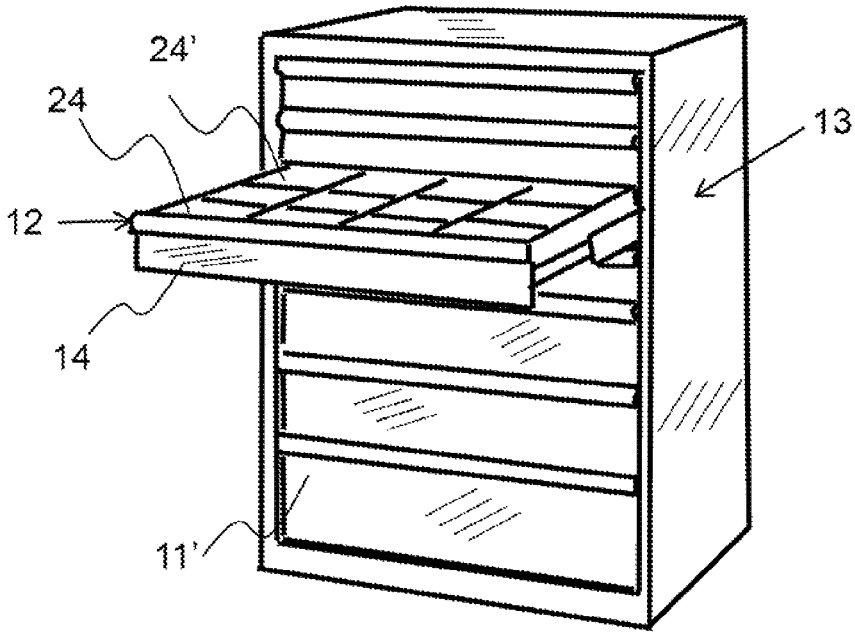

FIG. 1 shows an isometric view of an exemplary parts storage system as described herein.

Figure 2:
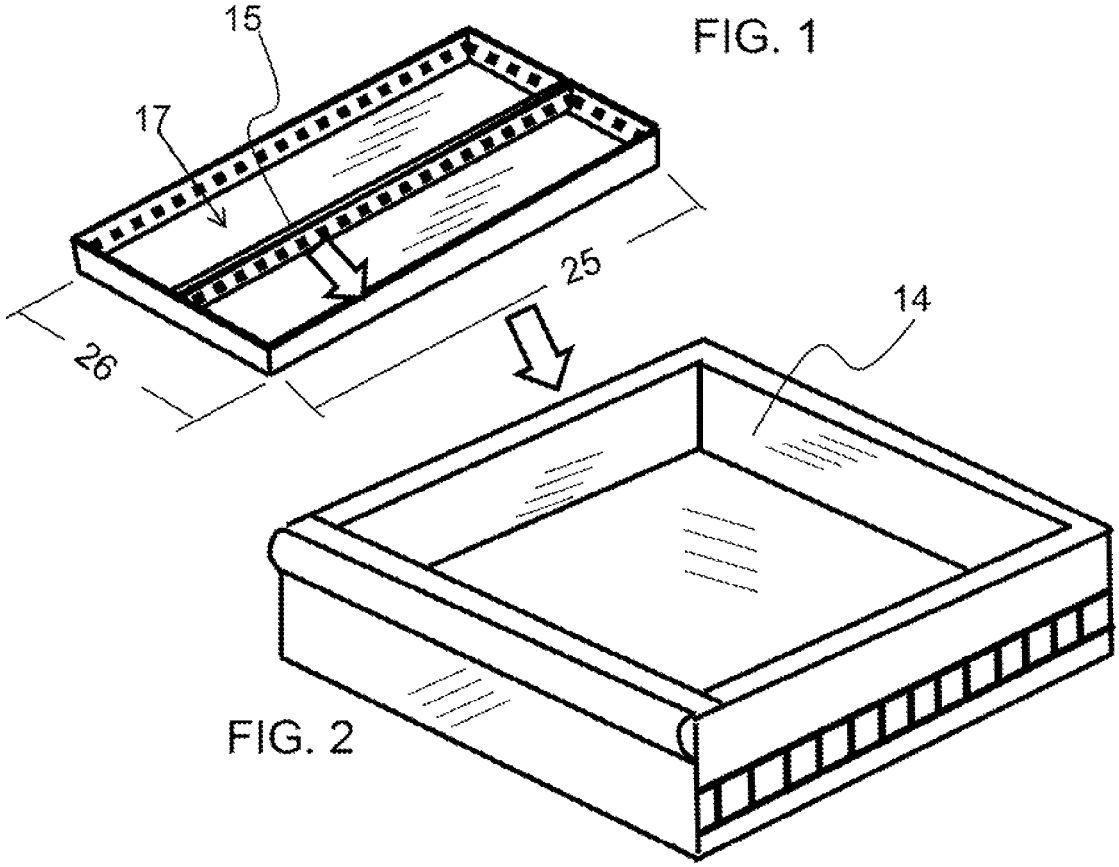

FIG. 2 shows an isometric view of an insert tray configured for insertion into a parts storage drawer.

Figure 3:
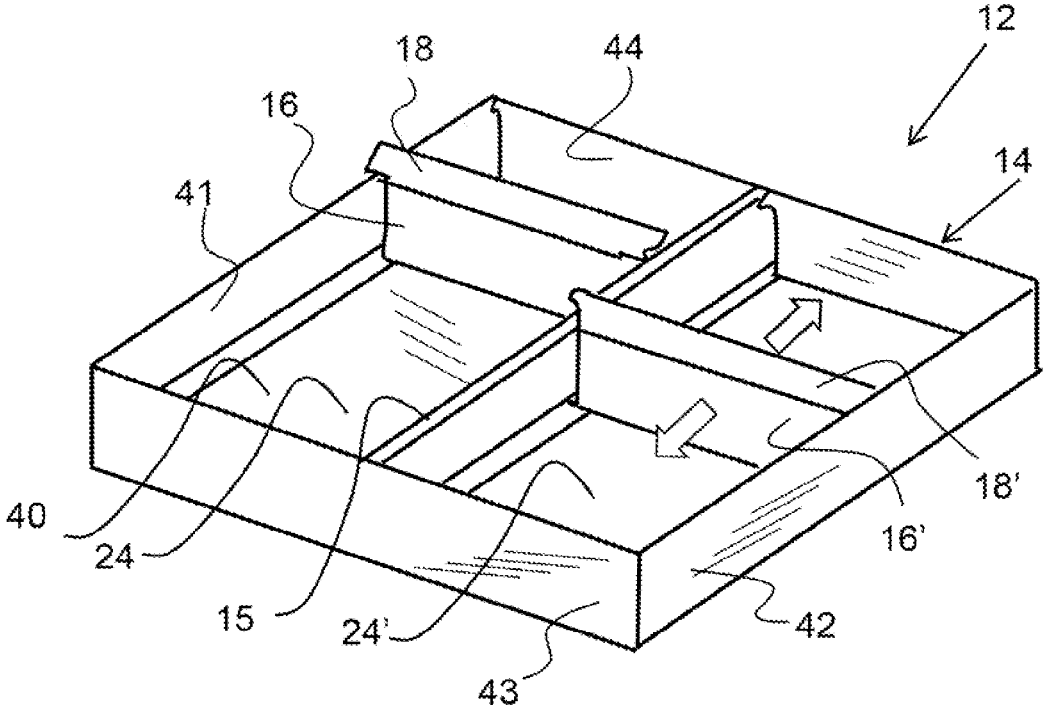

FIG. 3 shows an isometric view of an exemplary insert tray as described herein.

Figure 4A:
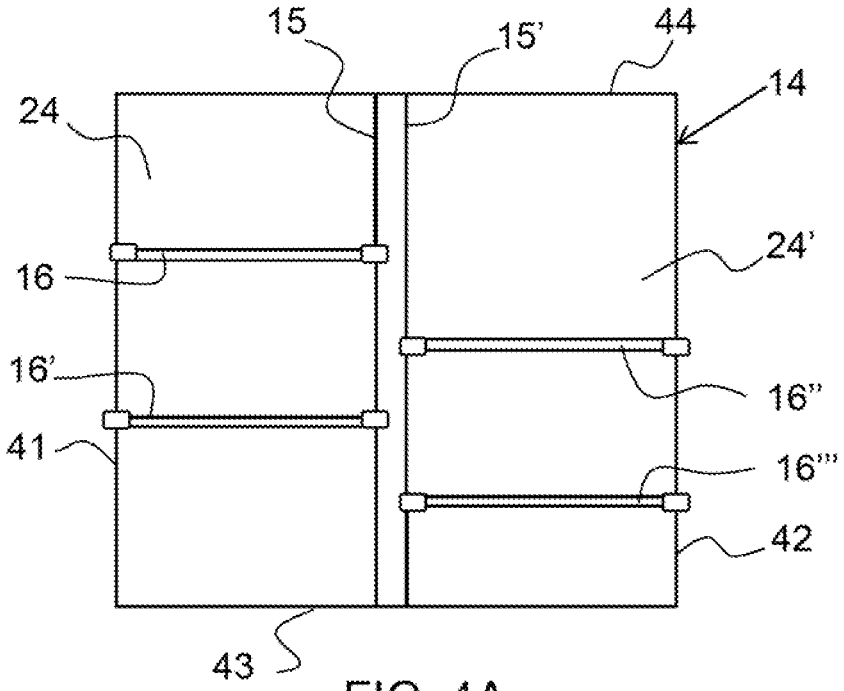
Figure 4B:
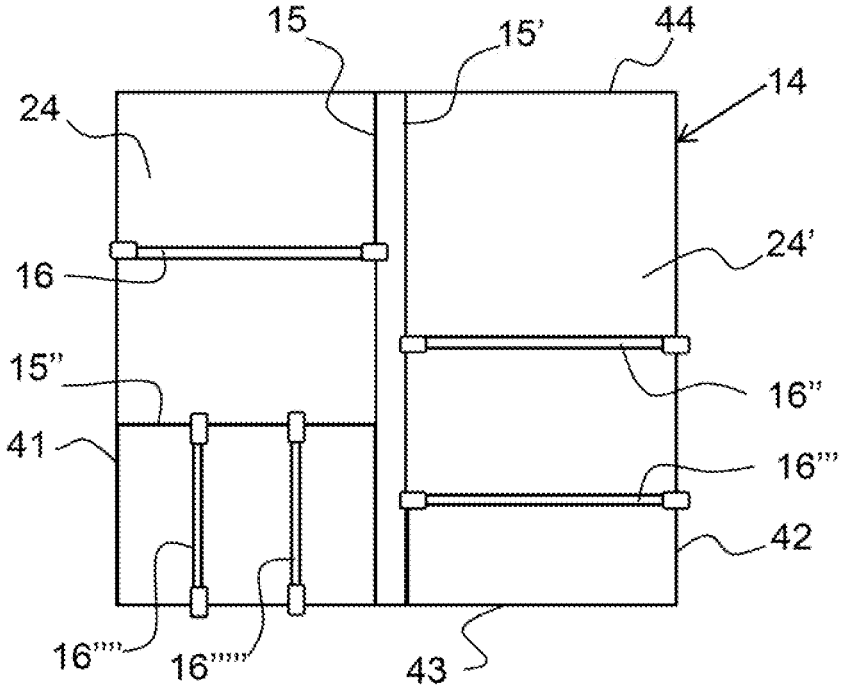

FIG. 4A and FIG. 4B show top down views of an exemplary storage drawers as describe herein.

Figure 5:
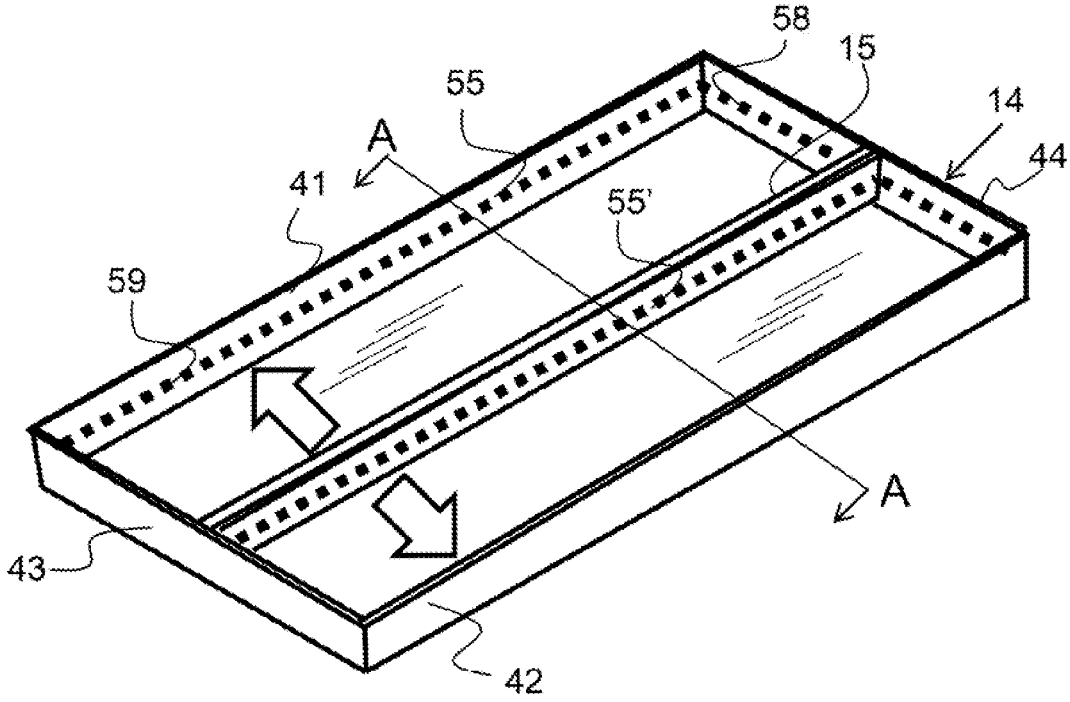

FIG. 5 shows an isometric view of an exemplary insert tray as described herein.

Figure 6:
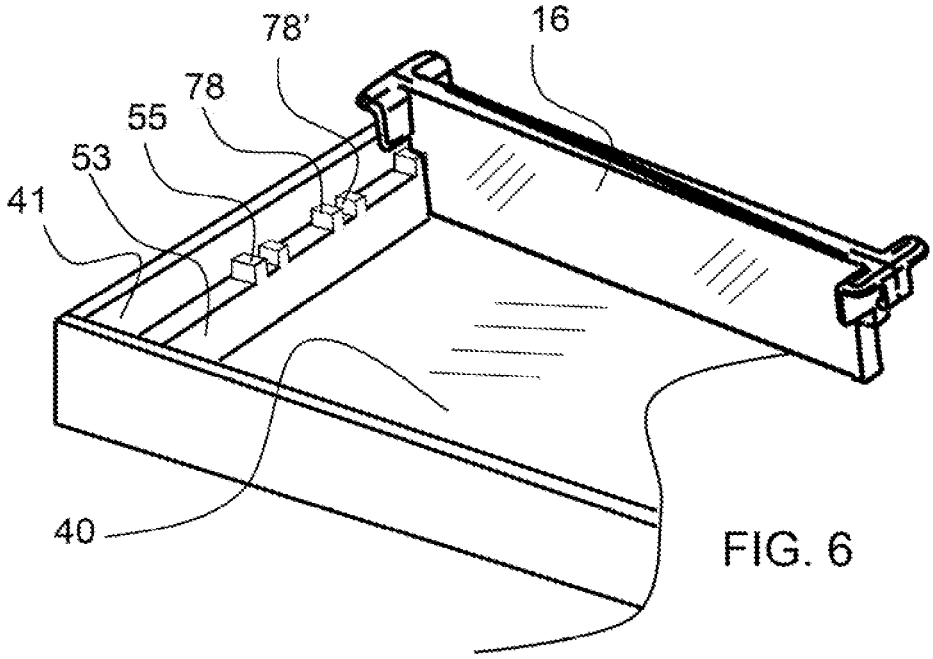

FIG. 6 shows an isometric view of an exemplary storage drawer having locking segments as described herein.

Figure 7:
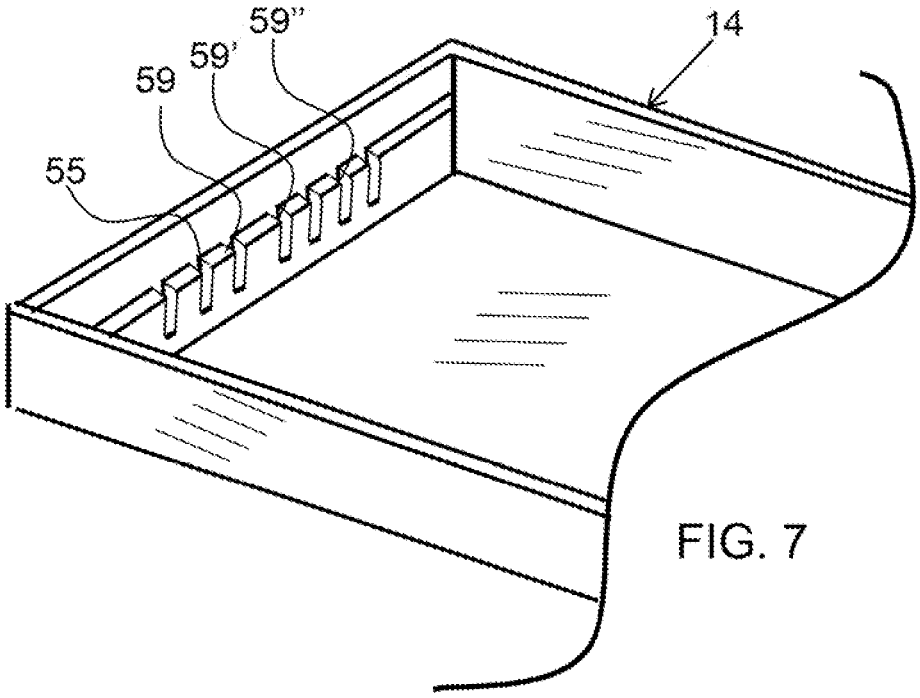

FIG. 7 shows an isometric view of an exemplary storage drawer having locking segments as described herein.

Figure 8:
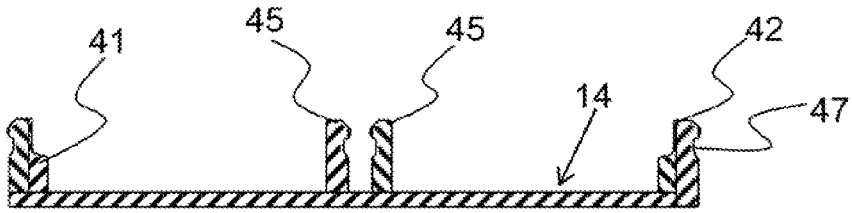

FIG. 8 shows a cross section view along line AA of FIG. 5.

Figure 9:
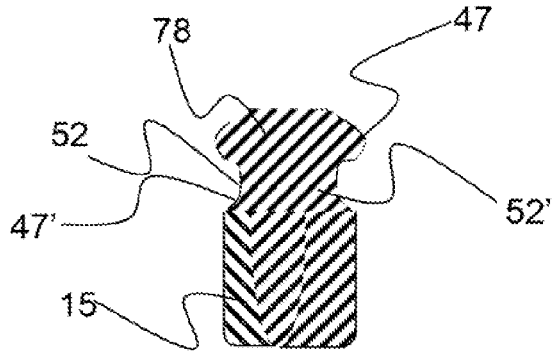

FIG. 9 shows a cross section view of a partition configured for attachment of a divider on both sides.

Figure 10A:
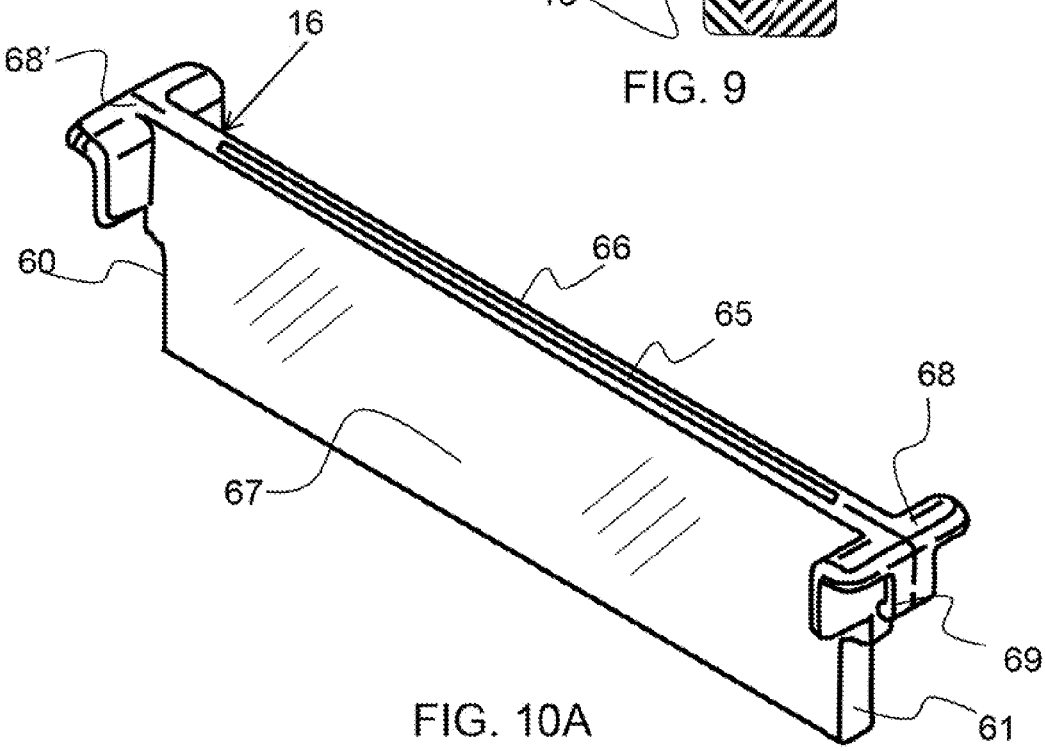

FIG. 10A shows an isometric view of an exemplary divider as described herein.

Figure 10B:
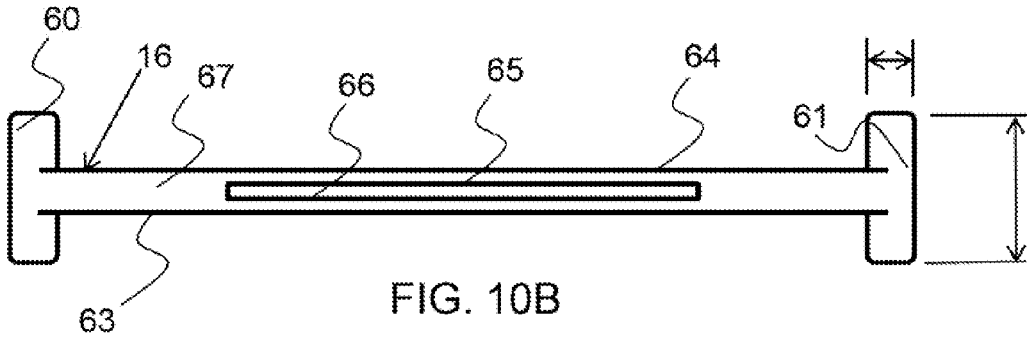

FIG. 10B shows a top down view of the divider shown in FIG. 10A.

Figure 10C:
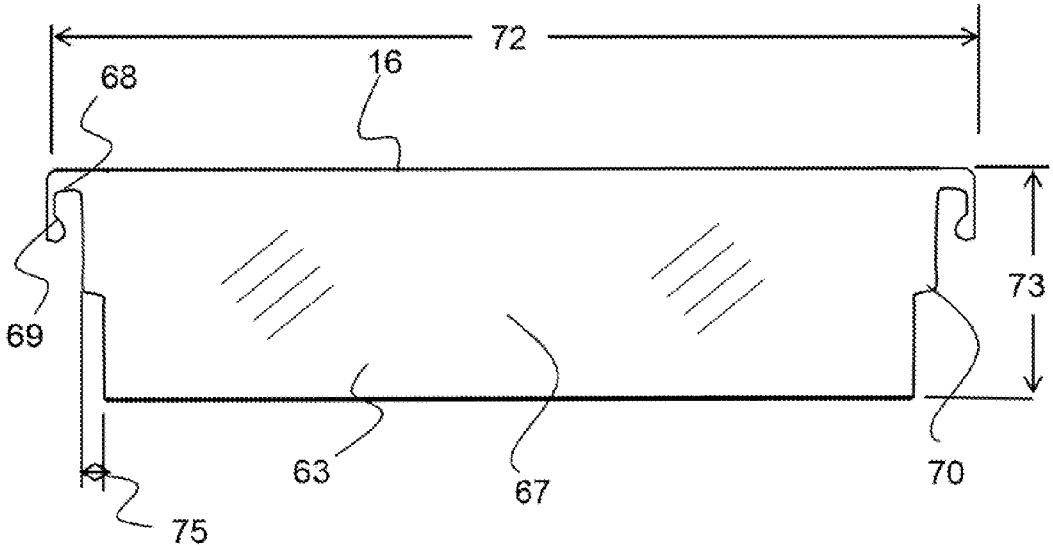

FIG. 10C shows a side view of the divider shown in FIG. 10A.

Figure 11:
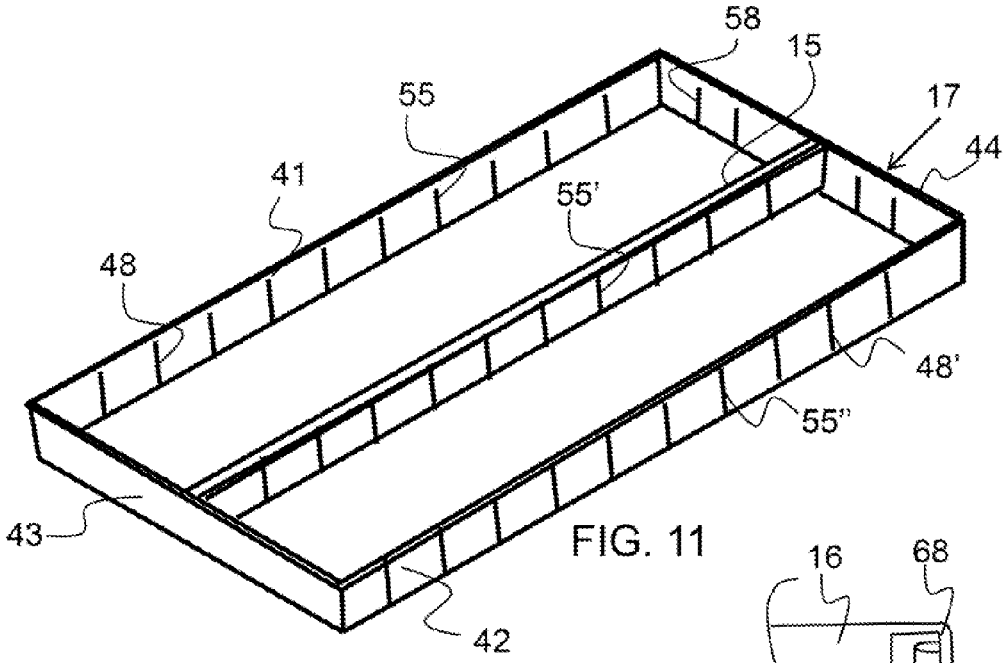

FIG. 11 shows an isometric view of an exemplary storage drawer having slot type locking segments as described herein.

Figure 12:
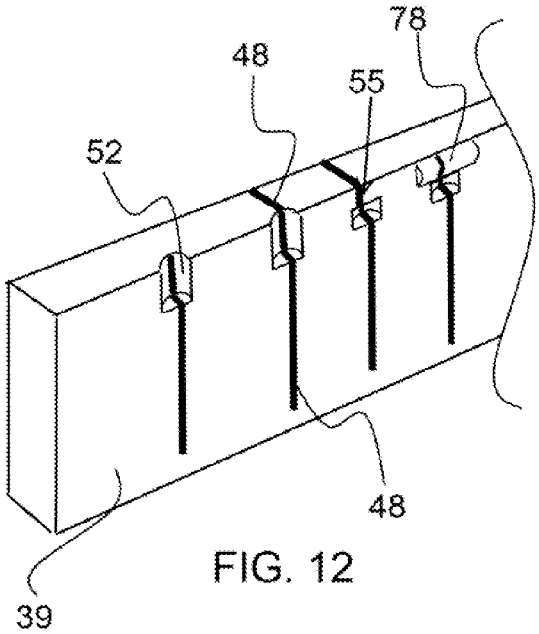

FIG. 12 shows an isometric view of a portion of exemplary partition having slot type locking segments and recesses for coupling with a clip portion.

Figure 13A:
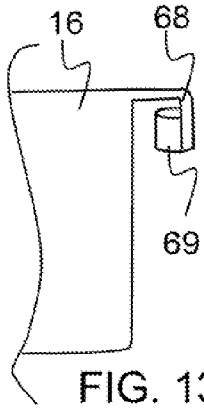
Figure 13B:
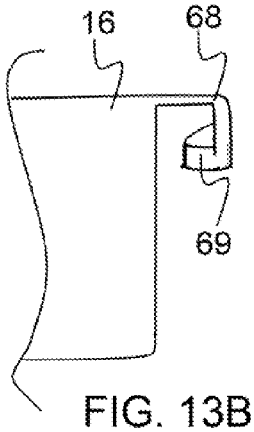

FIGS. 13A and 13B show side views of a divider having a clip portion with an enlarged clip portion.

Figure 14A:
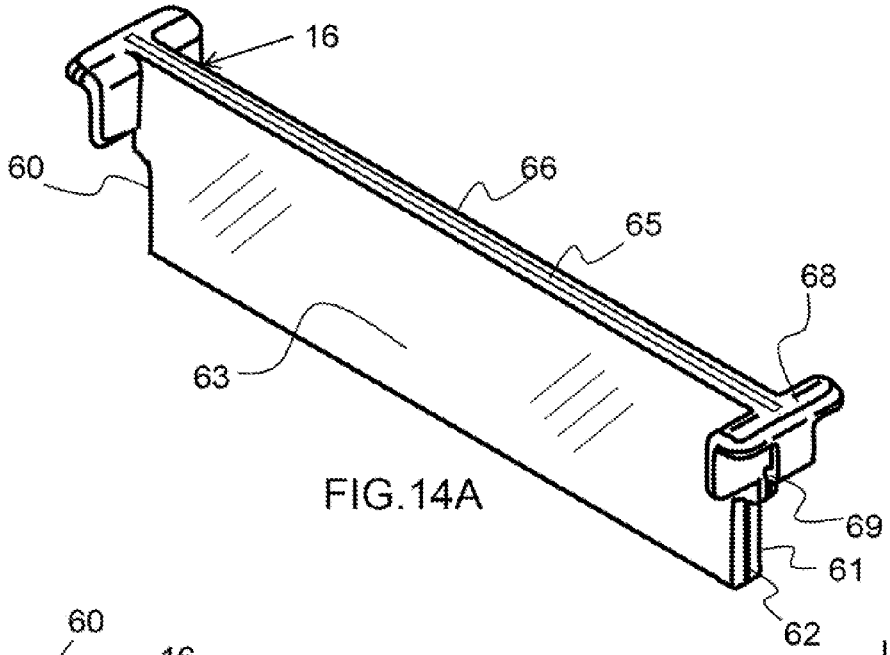

FIG. 14A shows an isometric view of an exemplary divider having a divider end slot as described herein.

Figure 14B:
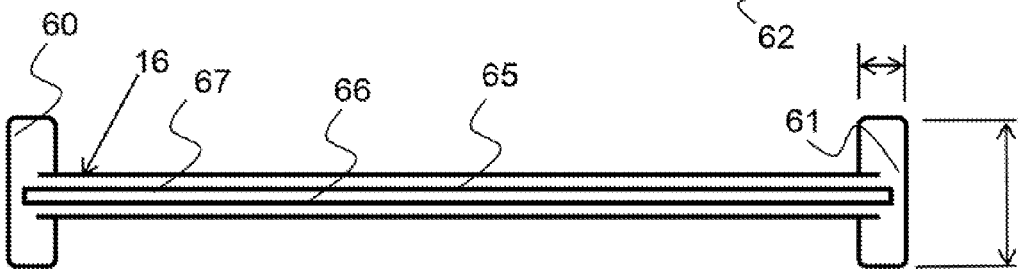

FIG. 14B shows a top down view of the divider shown in FIG. 14A.

Figure 14C:
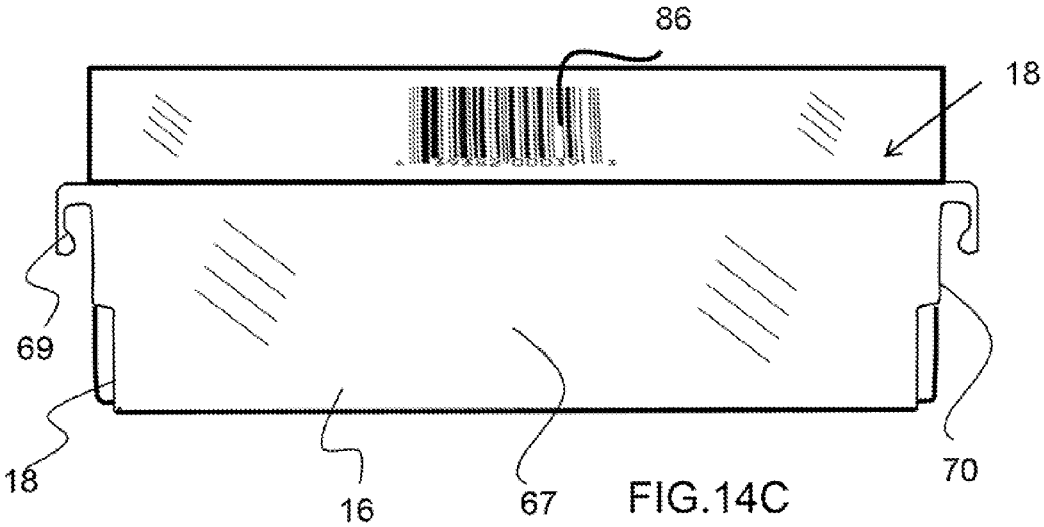

FIG. 14C shows a side view of the divider shown in FIG. 14A with an identification card inserted therein.

Figure 15A:
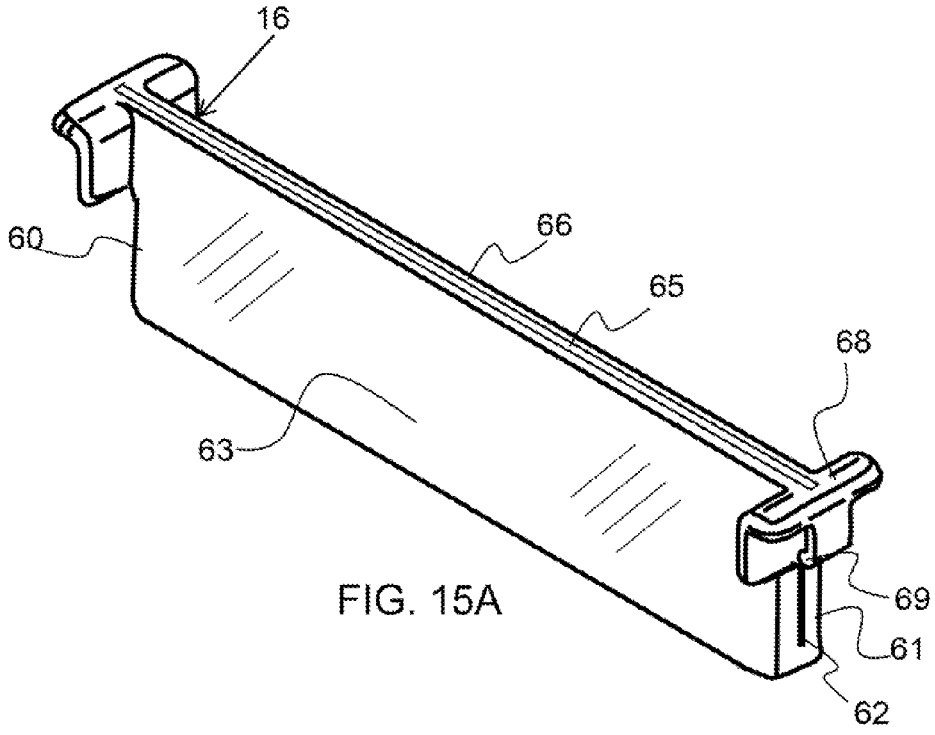

FIG. 15A shows an isometric view of an exemplary divider having a divider end slot as described herein.

Figure 15B:
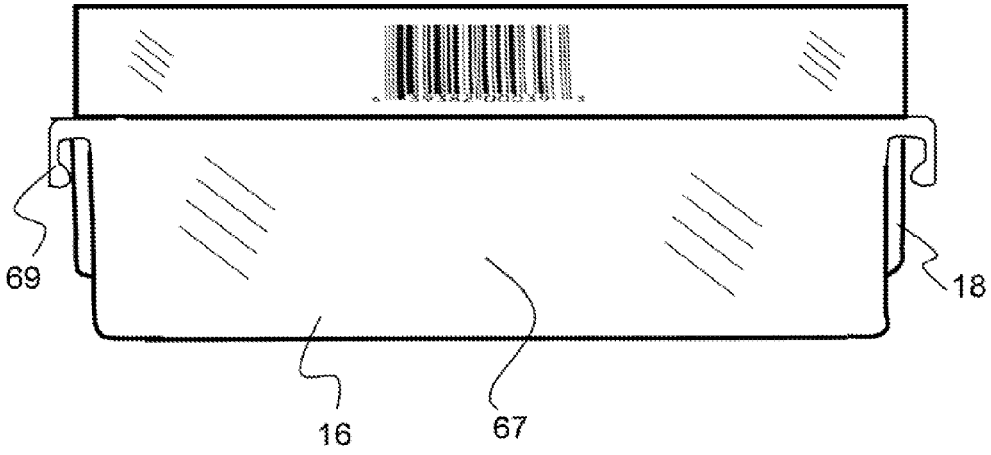

FIG. 15B shows a side view of the divider shown in FIG. 15A with an identification card inserted therein.

Figure 16:
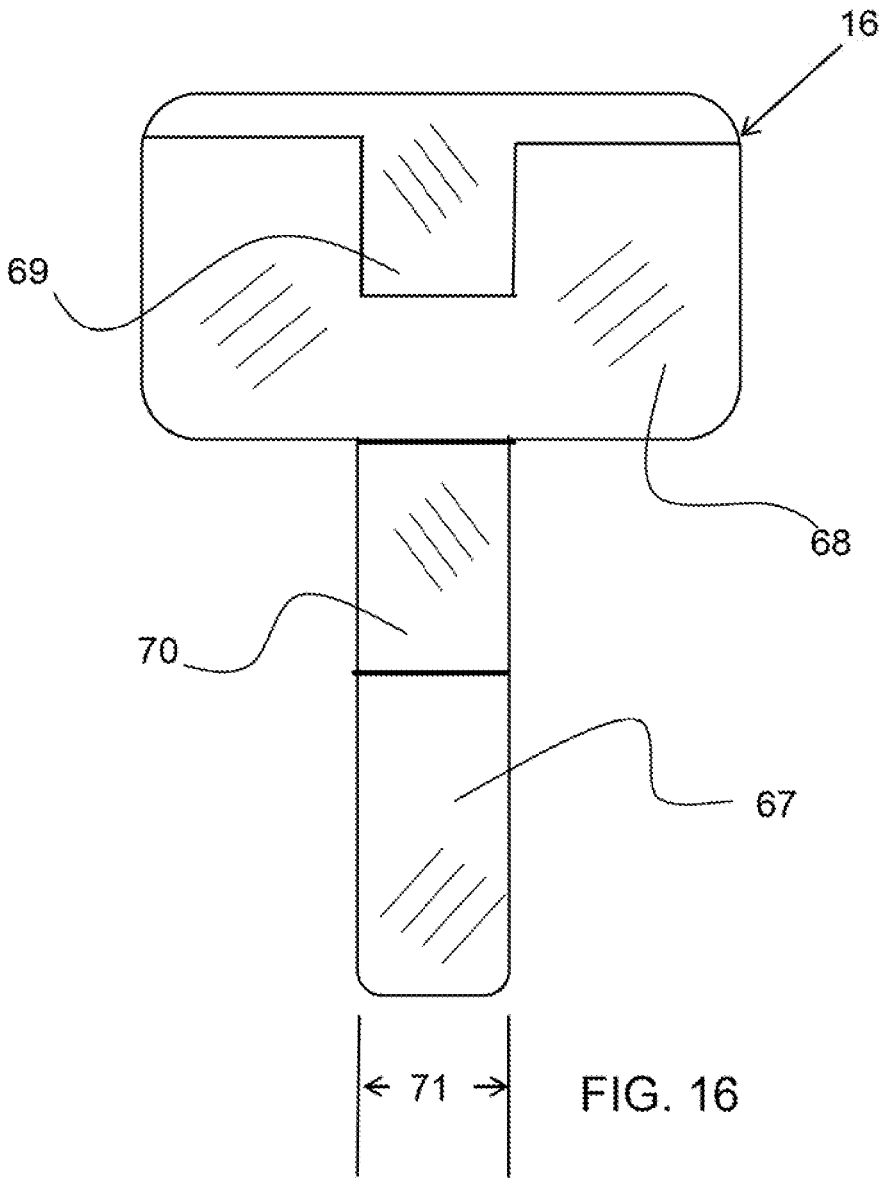

FIG. 16 shows an end view of an exemplary divider having a divider clip.

Figure 17:
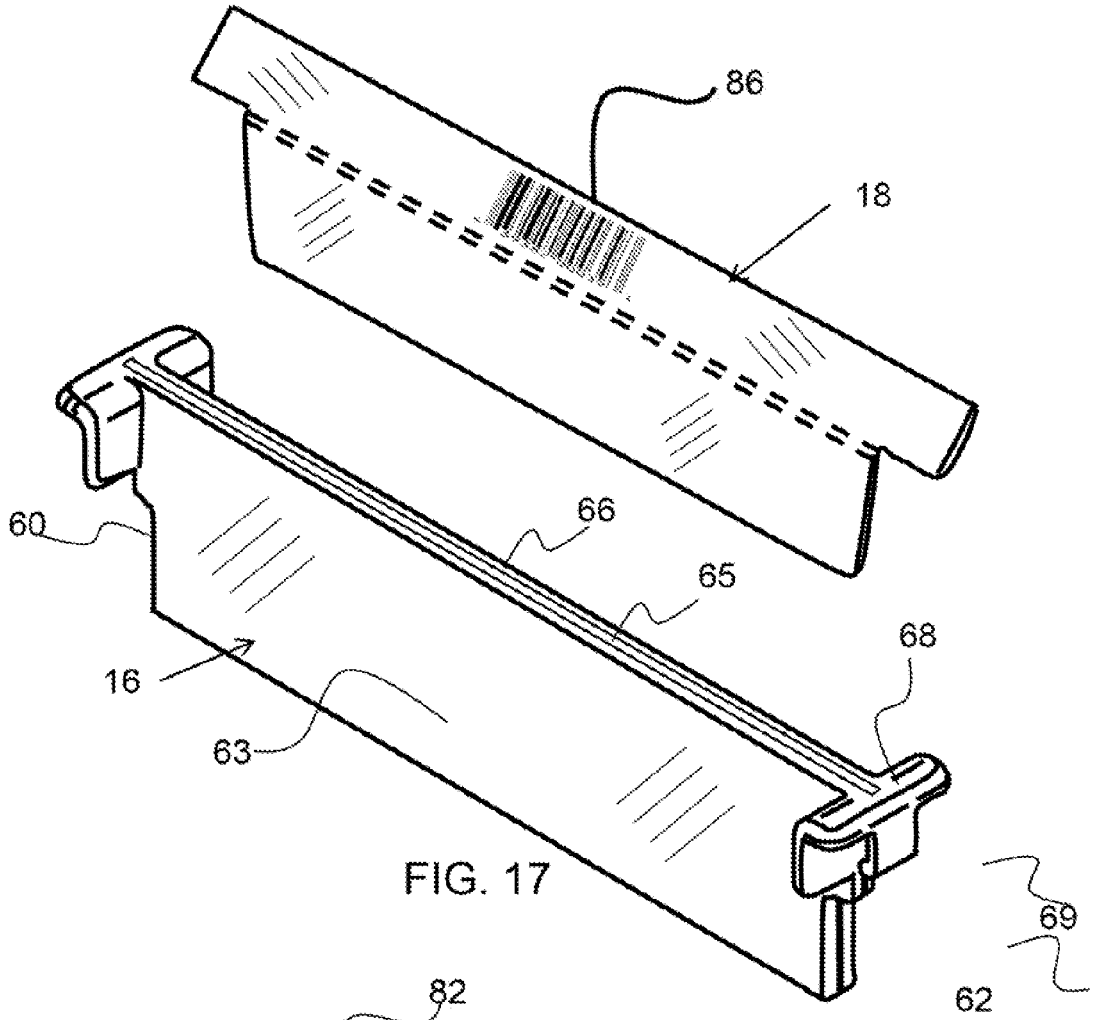

FIG. 17 shows an isometric view of an exemplary parts identification card and divider as described herein.

Figure 18:
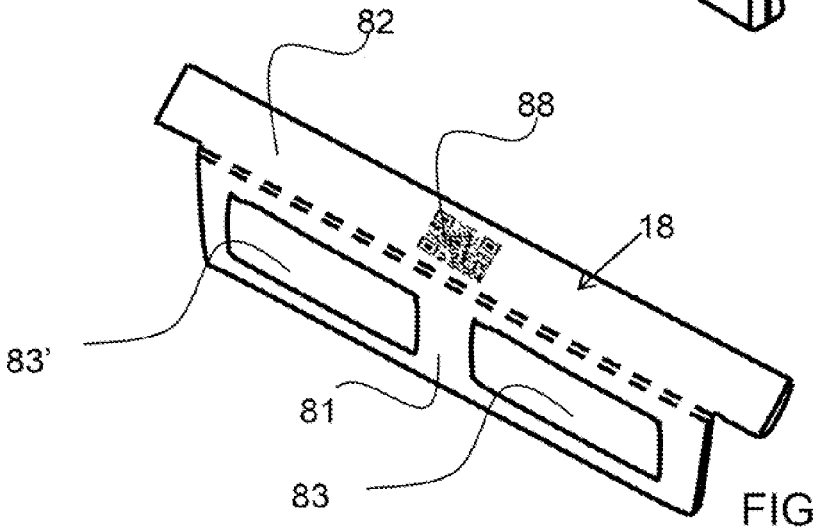

FIG. 18 shows an isometric view of an exemplary parts identification card as described herein.

Figure 19:
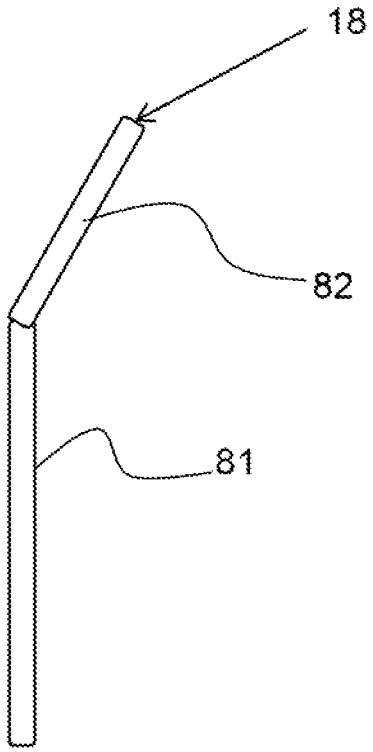

FIG. 19 shows an end view of an exemplary parts identification card as described herein.

Figure 20:
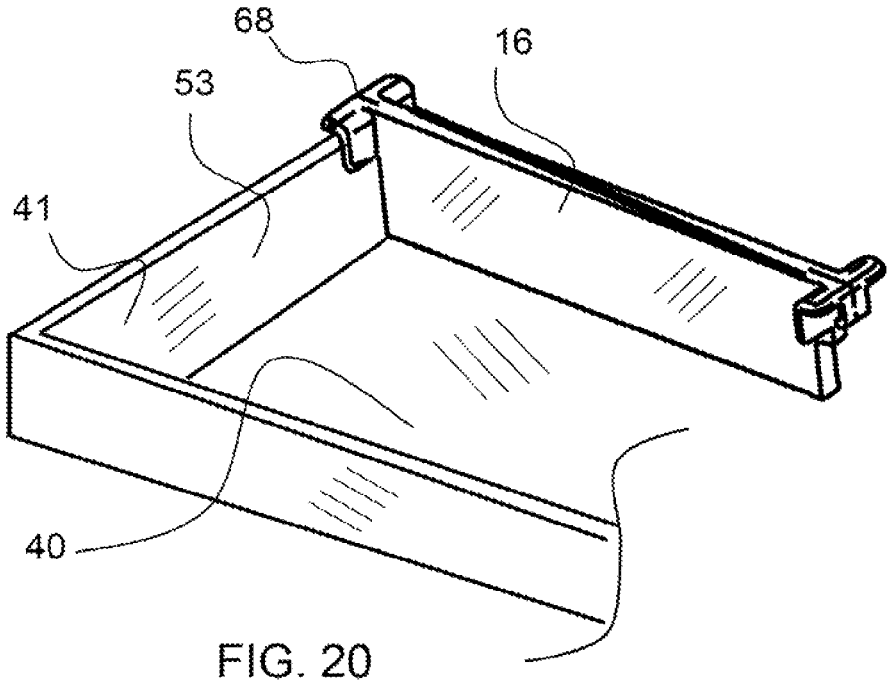

FIG. 20 shows an isometric view of an exemplary parts storage system having a partition with a smooth base portion.

Figure 21:
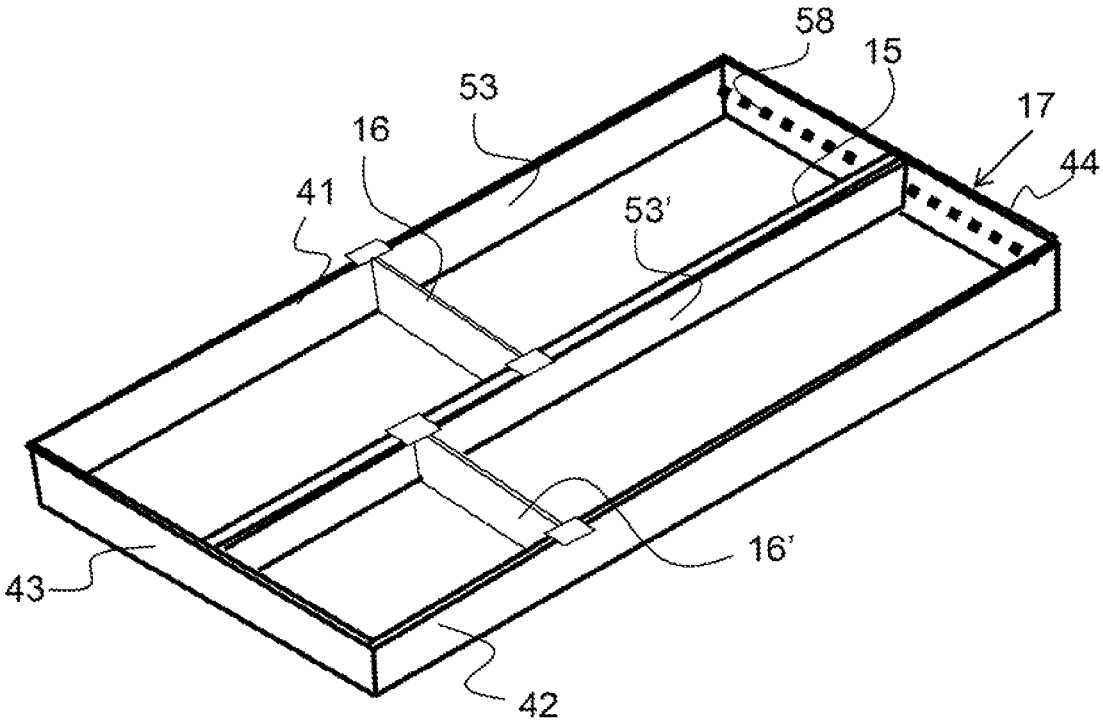

FIG. 21 shows an isometric view of an exemplary insert tray having dividers and rails with smooth base portions.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale; some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention and certain modifications, combinations and improvements of the described embodiments, will occur to those skilled in the art and all such alternate embodiments, combinations, modifications and improvements are within the scope of the present invention.

As shown in FIG. 1, a parts storage system 12 as described herein may comprise a storage drawer 14, having a plurality of adjustable storage bins 24. A plurality of storage drawers 14 may be placed into a cabinet 13, as shown in FIG. 1.

As shown in FIG. 2, an insert tray 17, may be configured to attach to or be placed in a storage drawer 14. As shown in FIG. 2, the insert tray 17 is an integral type insert tray formed from a single piece of material by molding, for example. Any number of insert trays may be configured for insertion in a drawer. An insert tray may have any suitable dimensions. The length 25 of an insert tray may be selected to approximately match the length of a drawer as shown in FIG. 2, or may be some fraction of a drawer length. Likewise, the width 26 of an insert tray may be selected to approximately match the width of a drawer, or may be, for example, approximately one half the width of a drawer as shown in FIG. 2, thereby providing room for two insert trays to fit into a single drawer. A plurality of insert trays may be desirable if a drawer is large and lifting or otherwise manipulating a full drawer sized insert tray is cumbersome or difficult.

As shown in FIG. 3, a parts storage system 12 as described herein, may comprise a storage drawer 14 having a plurality of adjustable storage bins 24, at least one partition 15 and at least one divider 16. The dividers 16 can be quickly and easily moved as indicated by the arrows next to divider 16', by simply pulling or tilting the divider and dragging the divider to a new location and retaining it in locking segments (not shown). The storage drawer 14 shown in FIG. 3 comprises a base 40, left side rail 41, right side rail 42, front rail 43, and back rail 44. In addition, as shown FIG. 3, the dividers 16 and 16' have part identification cards 18, 18' attached thereto.

As shown in FIG. 4A, a plurality of dividers 16 may be arranged in any suitable location within a parts storage drawer 14. Parts bins 24, 24' of different sizes may be configured as shown in FIG. 4A. Two partitions 15 and 15' are configured between the front rail 43 and back rail 44.

As shown in FIG. 4B, a plurality of dividers 16 may be arranged in any suitable location within a parts storage drawer 14. Parts bins 24, 24' of different sizes may be configured as shown in FIG. 4B. Two partitions 15 and 15' are configured between the front rail 43 and back rail 44, and partition 15" is configured between the left rail 41 and partition 15. Dividers are inserted between partition 15" and the front rail 43. Three storage bins are formed between partition 15" and the front rail 43.

As shown in FIG. 5, a storage drawer 14 is configured with rails having locking segments 55. The locking segments 55 may be grooves that are configured to accept a divider and/or a partition. In one embodiment, a partition retainer 58 is configured to accept and retain the end of a partition 15, as shown in FIG. 5. In this configuration, a partition may be moved to any suitable location as indicated by the arrows, thereby adjusting the size of bins.

As shown in FIG. 6, a left rail 41 comprises integral lock segments 55. An integral lock segment is configured directly into the rail or partition such as by molding. As shown in FIG. 6, protrusions 78, 78' are configured along the rail and are configured to retain a divider 16 when inserted between the two protrusions 78, 78'. Any suitable number and configuration of protrusion type locking segments may be used. Also shown in FIG. 6 is a rail having a smooth base portion 53, wherein the portion of the rail adjacent to and extending up from the base 40 is smooth and comprises no locking segments. A smooth base portion 53 may prevent parts within bins from getting caught on locking segments that extend down to the base. A smooth base portion 53 may extend up from the base any suitable length including, but not limited to, at least about one quarter the height of the rail, at least about one half the height of the rail or at least about three quarter the height of the rail. The smooth base portion 53 shown in FIG. 6 extends approximately one half way up the height of the rail 41.

As shown in FIG. 7, the left rail 41 comprises integral lock segments 55. As shown in FIG. 7, grooves 59 are configured out of the rail material. In an alternative embodiment, a separate piece of material may be used for the locking segment, and this separate piece of material may be attached to a rail or partition.

The cross sectional view of the storage drawer shown in FIG. 5, taken along line A-A, is shown in FIG. 8. Two partitions are shown in the center of the cross-section, each with a geometry configured to accept a divider clip 68. Each partition and rail shown in FIG. 8 has a clip receiver 47, such as a recess, wherein an enlarged portion of a clip 69 as shown in FIG. 10A and FIG. 10C may nest.

As shown in the cross-sectional view of a partition in FIG. 9, a partition may be configured to accept a divider on either side, having a clip receiver 47, 47' comprising recess 52, 52' on either side of the partition 15.

As shown if FIG. 10A, an exemplary divider 16 comprises a body portion 67, and divider clips 68' 68 on both a first end 60 and second end 61. The divider clips have an extended portion with an enlarged clip portion 69. In addition, the divider comprises a part identification card retainer 65 that is an opening 66, or slot wherein a part identification card may be inserted. FIG. 10B shows a top down view of the divider 16 shown in FIG. 10A. The part identification card retainer opening 66 is shown in the body portion 67 of the divider 16. Any suitable means to retain the part identification card may be incorporated, and may attach a part identification card to the first 63 or second side 64 of a divider. FIG. 10C shows a side view the divider 16 shown in FIG. 10A. The divider clip 68 geometry is shown having an extended end with an enlarged clip portion 69. The divider clip configuration shown will flex outward when the divider is pressed down onto a partition or rail. In addition, a geometric retainer portion 70 is shown in FIG. 10C, where the width of the divider 16 is enlarged. The geometric retainer portion 70 has a width 75 that is configured for insertion into a lock segment, as shown in FIG. 6.

FIG. 11 shows an insert tray 17 having slot type 48 lock segments 55. The slots may be configured for insertion of a divider, and/or parts identification card. The slots extend through the rail as shown by the right rail 42 having slots 48' extending to the outside surface of the insert tray 17. Any type of lock segment 55 may be configured on the inside and/or outside surface of a rail.

FIG. 12 shows a portion of a rail 39 having slot type 48 lock segments 55. The slots may be configured for insertion of a divider, and/or a parts identification card. The slot may be configured to align with a recess 52, or rail protrusion 78. A slot 48, may extend along any suitable portion of a rail, and in an exemplary embodiment is aligned generally vertically as shown in FIG. 12. A slot may extend through the thickness of a rail, or may extend along a portion of the thickness of a rail. A slot type locking segment is typically narrow in width, and may have a width of no more than 5 mm, no more than 3 mm, no more than 2 mm, and any range between and including the widths provided.

As shown in FIG. 13A, a divider 16 comprises a clip 68 having an enlarged clip portion 69 that is configured for coupling with a rail recess 52 (not shown). The enlarged clip portion 69 has a partial cylindrical geometry that is configured for coupling with the partial cylindrical geometry recess as shown in FIG. 12. An enlarged clip portion may have any suitable geometry, however a rounded geometry may be preferred as it allow for easy manipulation of the divider along rails. In an exemplary embodiment, an enlarged portion of a clip comprises a cylindrical geometry aligned perpendicular to the divider.

As shown in FIG. 13B the enlarged portion 69 has a partial cylindrical geometry and a contour that is configured to nest with a rail protrusion 78, as shown in FIG. 12, for example. The enlarged portion shown in FIG. 13B would retain the divider both horizontally along the rail and also retain it vertically.

FIGS. 14A-14C show a divider 16 having a divider end slot 62, that is configured to allow a part identification card 18 to be inserted there through. A divider end slot 62 may be configured along any suitable portion of the divider end. A part identification card 18, may be inserted and extend beyond the end of the divider 16, as shown in FIG. 14C. The divider shown in FIG. 14 has a geometric retainer portion 70. The geometric retainer portion 70 is a wider portion of the body portion 67. The part identification card 18 may be configured to extend from the divider 16, in the more narrow body portion 16, as shown in FIG. 14C.

FIGS. 15A and 15B show a divider 16 having a divider end slot 62, that is configured to allow a part identification card 18 to be inserted there through. A divider end slot 62 may be configured along any suitable portion of the divider end. A part identification card 18, may be inserted and extend beyond the end of the divider 16, as shown in FIG. 15B.

FIG. 16 shows an end view of a divider 16 having a divider clip 68 and a geometric retainer portion 70. The body portion 67 may have any suitable thickness 71 including, but not limited to, greater than about 3 mm, greater than about 5 mm, greater than about 10 mm, greater that about 15 mm, greater than about 20 mm, and any range between and including the thickness values provided.

FIG. 17 shows an isometric view of a part identification card 18 having a bar code 86. The card is configured for insertion into the opening 66, of the part identification card retainer 65. The part identification card 18, has a wider portion that will not fit into the opening 66.

FIG. 18 shows an isometric view of a part identification card 18 having a QR code 88. In addition, the exemplary part identification card comprises two openings 83, 83' that may be incorporated to reduce weight and materials. The exemplary part identification card has a card retainer portion 81, and a label portion 82. The card retainer portion is configured for attachment, such as by insertion in an opening, to a divider. The label portion 82 is configured for attachment of a label, and may have slots or clips for retaining a label. Any suitable way to hold a label may be employed on the part identification card described herein. Any suitable type of label may be used as well, including a bar code, QR code, printed or hand written labels and the like. A label retainer may comprise a slot for accepting a label, thereby allowing for replacement of labels as necessary.

FIG. 19, shows and end view of a part identification card 18. The label portion 82 is configured at an angle to the retainer portion to provide better viewing.

FIG. 20 shows an isometric view of an exemplary parts storage system having a partition with a smooth base portion 53. In this configuration, the divider is coupled to and retained by the divider clip 68 and clip receiver. Smooth inside surfaces of the bin may effectively prevent parts from being caught on locking segments.

FIG. 21 shows an isometric view of an exemplary insert tray 17 having dividers and rails with smooth base portions 53. Again, in this configuration, the smooth inner surfaces of the bin may be preferred for small parts that are susceptible to getting caught on or stuck in locking segments.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

DEFINITIONS

An integral insert tray, as used herein, is an insert tray made out of a single piece of material, such as by injection molding and may include an integral partition rail.

Rail, as used herein, includes a partition or partition rail, front, back, or side rails.

The term "storage drawer insert tray" may be abbreviated as drawer insert tray or simply insert tray for the purposes of this application.

What is claimed is:

1. A parts storage system comprising an adjustable storage drawer comprising:

a base;

two opposing side rails;

a front rail and an opposing back rail;

at least one partition rail between two opposed rails and comprising:

a rail height, a plurality of lock segments configured along a first side of said partition rail and a portion up said rail height from said base;

wherein said plurality of lock segments do not extend to a top of said partition rail; and clip receivers configured on a second and opposing side of said partition rail, the tops of said side, front back, and at least one partition wherein rails are smooth and have no lock segment nor clip receiver configured thereon;

at least one divider configured to be detachably attached between rails comprising:

a first end;

a second end;

a top;

a first side defining the front of the divider;

a second side defining the back of the divider;

a body portion comprising:

a geometric retainer portion that is a wider portion of said body portion proximate said top and configured for insertion down and into said lock segment;

clips extending from said first end and said second end comprising:

an extended portion configured to extend over the top and down the opposing second side of said partition rail;

an enlarged clip portion configured on said extended portion for engagement with said clip receiver;

whereby said enlarged clip portion is configured to engage with said clip receivers on the second side of said rail and said geometric retainer portion is configured to engage with lock segments on the first side of said rail a part identification card comprising: a card retainer portion and a label portion; an identification card retainer configured in the divider and comprising: an opening in said top of said divider between said clips and extending down substantially midway between said first side of said divider and said second side of said divider; whereby said part identification card is configured to be partially inserted into said opening whereby said card retainer portion is retained in said opening, and wherein said part identification card is configured to be detachably attached to said divider;

whereby a divider can be removed from a lock segment, tilted with said body portion between said rails, slid with said clips engaging said top of said rails to position said divider in a new location between said rails; said clips engaged with said clip receivers and said geometric retainer portion secured into said lock segment thereby providing an adjustable configuration;

at least two bins separated by said divider.

2. The part storage system of claim 1, wherein the base, the two opposed side rails, the front rail and the opposed back rail are configured into an insert tray.

3. The part storage system of claim 2, wherein the base, the two opposed side rails and the front rail and the opposed back rail are configured into an integral insert tray.

4. The part storage system of claim 3, wherein at least one of said at least one partition rail configured between two opposed rails is an integral partition rail.

5. The part storage system of claim 1, wherein the lock segments comprise a groove lock segments.

6. The part storage system of claim 1, wherein the lock segments comprise a protrusion lock segments.

7. The part storage system of claim 1, wherein the lock segments comprise a slot lock segments.

8. The parts storage system of claim 7, wherein a divider comprises a divider end slot configured for insertion of an identification card there through, whereby said identification card is retained by the slot lock segment.

9. The part storage system of claim 1, wherein a partition rail comprises a clip receiver on both a first and second side, whereby the extended portion of a clip is configured to extend over the top of said partition rail and engage with said clip receiver.

10. The part storage system of claim 1, wherein a groove lock segment comprises at least five grooves spaced no more than about 12 mm apart wherein said groove lock segment are positioned along a side of the rail, with an opening to said groove lock segment located a portion up a rail height.

11. The part storage system of claim 1, wherein a lock segment is an integral part of a rail.

12. The part storage system of claim 10, wherein the clip receiver comprises a protrusion.

13. The part storage system of claim 10, wherein the clip receiver comprises a recess.

14. The part storage system of claim 1, wherein the tray consists essentially of a medical sterilizable material.

* * * * *